US010094209B2

(12) United States Patent
Gillan et al.

(10) Patent No.: US 10,094,209 B2
(45) Date of Patent: Oct. 9, 2018

(54) DRILL PIPE OSCILLATION REGIME FOR SLIDE DRILLING

(71) Applicant: CANRIG DRILLING TECHNOLOGY LTD., Houston, TX (US)

(72) Inventors: Colin Gillan, Houston, TX (US); Carlos Rolong, Cypress, TX (US); Mahmoud Hadi, Richmond, TX (US); Austin Groover, Spring, TX (US); Suresh Venugopal, Spring, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 674 days.

(21) Appl. No.: 14/555,103

(22) Filed: Nov. 26, 2014

(65) Prior Publication Data

US 2016/0145993 A1 May 26, 2016

(51) Int. Cl.

| | |
|---|---|
| ***E21B 44/00*** | (2006.01) |
| ***E21B 23/14*** | (2006.01) |
| ***E21B 7/06*** | (2006.01) |
| ***E21B 7/24*** | (2006.01) |

(52) U.S. Cl.

CPC ..... *E21B 44/00* (2013.01); *E21B 7/067* (2013.01); *E21B 7/24* (2013.01); *E21B 23/14* (2013.01)

(58) Field of Classification Search

None

See application file for complete search history.

(56) References Cited

U.S. PATENT DOCUMENTS

| | | | |
|---|---|---|---|
| 1,891,329 | A | 12/1932 | Le Compte et al. |
| 2,005,889 | A | 6/1935 | Dillon et al. |
| 2,724,574 | A | 11/1955 | Ledgeerwood, Jr. |
| 3,223,183 | A | 12/1965 | Varney |
| 3,265,359 | A | 8/1966 | Bowden |
| 3,407,886 | A | 10/1968 | Bennett |
| 3,550,697 | A | 12/1970 | Hobhouse |
| 4,384,625 | A | 5/1983 | Roper |
| 4,492,276 | A | 1/1985 | Kamp |

(Continued)

FOREIGN PATENT DOCUMENTS

| | | |
|---|---|---|
| EP | 0774563 B1 | 7/2002 |
| SU | 1668652 A1 | 8/1991 |

(Continued)

OTHER PUBLICATIONS

Petroleum Extension Service, "Controlled Directional Driling," N. Janicek (ed.), Third Edition, pp. 18-33 and 44-45, 1984.

(Continued)

*Primary Examiner* — Caroline N Butcher

(74) *Attorney, Agent, or Firm* — Haynes and Boone, LLP

(57) ABSTRACT

Apparatuses, methods, and systems include rotary drilling a first segment of a wellbore by rotating a drill string with a top drive forming a part of a drilling rig apparatus for a first period of time; obtaining data from a sensor disposed about the drilling rig apparatus while rotary drilling for at least a part of the first period of time; and based on the data from the sensor, determining a proposed oscillation revolution amount for the drill string to reduce friction of the drill string in the downhole bore without changing the direction of a bottom hole assembly while slide drilling.

24 Claims, 5 Drawing Sheets

(56) References Cited

U.S. PATENT DOCUMENTS

| | | | |
|---|---|---|---|
| 4,535,972 | A | 8/1985 | Millheim et al. |
| 4,662,608 | A | 5/1987 | Ball |
| 4,854,397 | A | 8/1989 | Warren et al. |
| 4,958,125 | A | 9/1990 | Jardine et al. |
| 5,103,919 | A | 4/1992 | Warren et al. |
| 5,103,920 | A | 4/1992 | Patton |
| 5,205,163 | A | 4/1993 | Sananikone |
| 5,358,059 | A | 10/1994 | Ho |
| 5,390,748 | A | 2/1995 | Goldman |
| 5,467,832 | A | 11/1995 | Orban et al. |
| 5,474,142 | A | 12/1995 | Bowden |
| 5,551,286 | A | 9/1996 | Booer |
| 5,713,422 | A | 2/1998 | Dhindsa |
| 5,730,234 | A | 3/1998 | Putot |
| 5,738,178 | A | 4/1998 | Williams et al. |
| 5,842,149 | A | 11/1998 | Harrell et al. |
| 6,026,912 | A | 2/2000 | King et al. |
| 6,029,951 | A | 2/2000 | Guggari |
| 6,050,348 | A | 4/2000 | Richarson et al. |
| 6,065,332 | A | 5/2000 | Dominick |
| 6,092,610 | A | 7/2000 | Kosmala et al. |
| 6,152,246 | A | 11/2000 | King et al. |
| 6,155,357 | A | 12/2000 | King et al. |
| 6,192,998 | B1 | 2/2001 | Pinckard |
| 6,233,498 | B1 | 5/2001 | King et al. |
| 6,293,356 | B1 | 9/2001 | King et al. |
| 6,382,331 | B1 | 5/2002 | Pinckard |
| 6,405,808 | B1 | 6/2002 | Edwards et al. |
| 6,523,623 | B1 | 2/2003 | Schuh |
| 6,757,613 | B2 | 6/2004 | Chapman et al. |
| 6,802,378 | B2 | 10/2004 | Haci et al. |
| 6,820,702 | B2 | 11/2004 | Niedermayr et al. |
| 6,892,812 | B2 | 5/2005 | Niedermayr et al. |
| 6,918,453 | B2 | 7/2005 | Haci et al. |
| 7,000,710 | B1 | 2/2006 | Umbach |
| 7,032,689 | B2 | 4/2006 | Goldman et al. |
| 7,044,239 | B2 | 5/2006 | Pinckard et al. |
| 7,059,427 | B2 | 6/2006 | Power et al. |
| 7,085,696 | B2 | 8/2006 | King |
| 7,096,979 | B2 | 8/2006 | Haci et al. |
| 7,243,735 | B2 | 7/2007 | Koederitz et al. |
| 7,357,196 | B2 | 4/2008 | Goldman et al. |
| 7,404,454 | B2 | 7/2008 | Hulick |
| 7,546,209 | B2 | 6/2009 | Williams |
| 7,584,788 | B2 | 9/2009 | Baron et al. |
| 7,665,533 | B2 | 2/2010 | Hopwood et al. |
| 7,775,297 | B2 | 8/2010 | Hopwood et al. |
| 7,802,634 | B2 | 9/2010 | Boone |
| 7,810,584 | B2 | 10/2010 | Haci et al. |
| 7,823,655 | B2 | 11/2010 | Boone et al. |
| 7,860,593 | B2 | 12/2010 | Boone |
| 7,882,902 | B2 | 2/2011 | Boutwell, Jr. |
| 7,938,197 | B2 | 5/2011 | Boone et al. |
| 8,215,417 | B2 | 7/2012 | Pradeep et al. |
| 8,510,081 | B2 | 8/2013 | Boone et al. |
| 8,528,663 | B2 | 9/2013 | Boone |
| 9,410,418 | B2 | 8/2016 | Papouras et al. |
| 2002/0104685 | A1 | 8/2002 | Pinckard et al. |
| 2003/0024738 | A1 | 2/2003 | Schuh |
| 2003/0051914 | A1 | 3/2003 | Bittar |
| 2004/0028476 | A1 | 2/2004 | Payne et al. |
| 2006/0185899 | A1 | 8/2006 | Alft et al. |
| 2007/0181343 | A1 | 8/2007 | Russell et al. |
| 2007/0203651 | A1 | 8/2007 | Blanz et al. |
| 2007/0256861 | A1 | 11/2007 | Hulick |
| 2008/0156531 | A1* | 7/2008 | Boone ..... E21B 7/06 175/27 |
| 2008/0173480 | A1 | 7/2008 | Annaiyaappa et al. |
| 2008/0281525 | A1 | 11/2008 | Boone |
| 2009/0058674 | A1 | 3/2009 | Papouras et al. |
| 2009/0078462 | A1 | 3/2009 | Boone et al. |
| 2009/0090555 | A1 | 4/2009 | Boone et al. |
| 2009/0152005 | A1 | 6/2009 | Chapman et al. |
| 2009/0159336 | A1 | 6/2009 | Boone |
| 2009/0250264 | A1 | 10/2009 | Dupriest |
| 2010/0121776 | A1 | 5/2010 | Stenger |
| 2010/0217530 | A1 | 8/2010 | Boone |
| 2011/0024187 | A1 | 2/2011 | Boone et al. |
| 2011/0024191 | A1 | 2/2011 | Boone |
| 2012/0228028 | A1 | 9/2012 | Turner et al. |
| 2013/0248248 | A1 | 9/2013 | Steidl et al. |
| 2014/0305702 | A1* | 10/2014 | Bowley ..... E21B 44/04 175/27 |

FOREIGN PATENT DOCUMENTS

| | | | |
|---|---|---|---|
| WO | WO 9312318 | A1 | 6/1993 |
| WO | WO 2004055325 | A1 | 7/2004 |
| WO | WO 2004109052 | A2 | 12/2004 |
| WO | WO 2006079847 | A1 | 8/2006 |
| WO | WO 2007073430 | A1 | 6/2007 |
| WO | WO 2008070829 | A2 | 6/2008 |
| WO | WO 2009039448 | A2 | 3/2009 |
| WO | WO 2009039453 | A2 | 3/2009 |
| WO | WO 2014147116 | A1 | 9/2014 |

OTHER PUBLICATIONS

Goldman, "Artificial Intelligence Applications Enhance Directional Control," *Petroleum Engineer International*, pp. 15-22, Feb. 1993.

Bonner, et al., "Measurements at the Bit: A New Generation of MWD Tools," *Oilfield Review*, pp. 44-54, Apr./Jul. 1993.

Jackson, et al., "Portable Top Drive Cuts Horizontal Drilling Costs," *World Oil Magazine*, vol. 214 Issue 11, pp. 81-89, Nov. 1993.

Murch, "Application of Top Drive Drilling to Horizontal Wells," Society of Petroleum Engineers—SPE 37100, 1996.

Plaintiff's Original Complaint; Case 6:09-cv-00414; Doc. 1; Sep. 16, 2009.

Answer to Plaintiff's Complaint; Case 6:09-cv-00414-LED; Doc 25; Nov. 6, 2006.

Defendant Helmerich & Payne's Invalidity Contentions;Case 6:09-cv-00414-LED; Mar. 25, 2010.

Defendant Omron Oilfield and Marine, Inc's Patent Rule 3-3 Disclosures; Case 6:09-cv-00414-LED; Mar. 25, 2010.

Defendant Omron Oilfield and Marine, Inc's Patent Rule 3-4 Disclosures; Case 6:09-cv-00414-LED; Mar. 25, 2010.

Helmerich & Payne, Inc.'s First Amended Answer and Counterclaims to Plaintiff's Orginal Complaint; Case 6:09-cv-00414-LED; Doc 55; Mar. 25, 2010.

Young, Jr., "Computerized Drilling Control", *Journal of Petroleum Technology*, 21(4): 483-96 (1969).

Brett, et al., "Field Experiences with Computer-Controlled Drilling", *Society of Petroleum Engineers 20107*, presented at *Permian Basin Oil and Gas Recovery Conference*, Midland, TX (Mar. 8-9, 1990).

"Wildcat ADS Automated Drilling System", Product Brochure, National Oilwell Varco, Inc. (2006).

"40223705-Series Wildcat Services Pneumatic Automated Drilling System," available at http://www.nov.com/Drilling/Control_and_Advisiory_Systems/Drawworks_Control_Auto_Drilling/Auto_Drillers.aspx (last visited Oct. 8, 2009).

Brown, et al., "In-Time Data Delivery", *Oilfield Review*, 11(4): 34-55, http://www.slb.com/media/services/resources/oilfieldreview/ors99/win99/pages34_55.pdf (Winter 1999/2000).

Gurari, E., "CIS 680: Data Structures: Chapter 19: Backtracking Atgorithms"; http://www.cse.ohio-state.edu/%7Egurari/course/cis680/cis680Ch19.html (1999).

Leine, et al., "Stick-Slip Whirl Interaction in Drillstring Dynamics", *J. of Vibration and Acoustics*, 124: 209-220 (2002).

Maidla, et al., "Understanding Torque: The Key to Slide-Drilling Directional Wells," IADC/SPE Drilling Conference, IADC/SPE 87162 (2004).

Dupriest, et al., "Maximizing Drill Rates with Real-Time Surveillance of Mechanical Specific Energy," SPE/IADC Drilling Conference 92194, Amsterdam, The Netherlands, pp. 1-10 (Feb. 23-25, 2005).

(56) References Cited

OTHER PUBLICATIONS

Dupriest, F., "Maximizing ROP with Real-Time Analysis of Digital Data and MSE," International Petroleum Technology Conference, Doha, Qatar, pp. 1-8 (Nov. 21-23, 2005).
Hartley, et al., "New Drilling Process Increases Rate of Penetration, Footage Per Day," *Offshore*, 66(1): 1-5 (2006).
Dupriest, F., "Comprehensive Drill-Rate Management Process to Maximize Rate of Penetration," SPE Annual Technology Conference and Exhibition, San Antonio, Texas, SPE 102210, pp. 1-9 (Sep. 24-27, 2006).
The International Searching Authority, "Written Opinion of the International Searching Authority," PCT/US2007/86768, dated Jun. 11, 2008.
Canrig's Answers to Omron Oilfield and Marine, Inc.'s First Set of Interrogatories, Civil Action No. 6:09-cv-00414, May 7, 2010.
Canrig Drilling Technology Ltd.'s Objections and Responses to Helmerick & Payne's First Set of Interrogatories, Civil Action No. 6:09-cv-00414, Aug. 23, 2010.
Defendant's Joint Preliminary Claim Construction and Extrinsic Evidence, Civil Action No. 6:09-cv-00414LED, Sep. 24, 2010.
Plaintiff Canrig's Local Patent Rule 4-2 Disclosures, Civil Action No. 6:09-cv-00414, Sep. 24, 2010.
Joint Claim Construction Statement, Civil Action No. 6:09-cv-00414LED, Oct. 25, 2010.

* cited by examiner

DRILL PIPE OSCILLATION REGIME FOR SLIDE DRILLING

BACKGROUND OF THE DISCLOSURE

Underground drilling involves drilling a bore through a formation deep in the Earth using a drill bit connected to a drill string. Two common drilling methods, often used within the same hole, include rotary drilling and slide drilling. Rotary drilling typically includes rotating the drilling string, including the drill bit at the end of the drill string, and driving it forward through subterranean formations. This rotation often occurs via a top drive or other rotary drive means at the surface, and as such, the entire drill string rotates to drive the bit. This is often used during straight runs, where the objective is to advance the bit in a substantially straight direction through the formation.

Slide drilling is often used to steer the drill bit to effect a turn in the drilling path. For example, slide drilling may employ a drilling motor with a bent housing incorporated into the bottom-hole assembly (BHA) of the drill string. During typical slide drilling, the drill string is not rotated and the drill bit is rotated exclusively by the drilling motor. The bent housing steers the drill bit in the desired direction as the drill string slides through the bore, thereby effectuating directional drilling. Alternatively, the steerable system can be operated in a rotating mode in which the drill string is rotated while the drilling motor is running.

Directional drilling can also be accomplished using rotary steerable systems which include a drilling motor that forms part of the BHA, as well as some type of steering device, such as extendable and retractable arms that apply lateral forces along a borehole wall to gradually effect a turn. In contrast to steerable motors, rotary steerable systems permit directional drilling to be conducted while the drill string is rotating. As the drill string rotates, frictional forces are reduced and more bit weight is typically available for drilling. Hence, a rotary steerable system can usually achieve a higher rate of penetration during directional drilling relative to a steerable motor, since the combined torque and power of the drill string rotation and the downhole motor are applied to the bit.

A problem with conventional slide drilling arises when the drill string is not rotated because much of the weight on the bit applied at the surface is countered by the friction of the drill pipe on the walls of the wellbore. This becomes particularly pronounced during long lengths of a horizontally drilled bore hole.

To reduce wellbore friction during slide drilling, a top drive may be used to oscillate or rotationally rock the drill string during slide drilling to reduce drag of the drill string in the wellbore. This oscillation can reduce friction in the borehole. However, too much oscillation can disrupt the direction of the drill bit sending it off-course during the slide drilling process, and too little oscillation can minimize the benefits of the friction reduction, resulting in low weight-on-bit and overly slow and inefficient slide drilling.

The parameters relating to the top-drive oscillation, such as the number of oscillating rotations, are typically programmed into the top drive system by an operator, and may not be optimal for every drilling situation. For example, the same number of oscillation revolutions may be used regardless of whether the drill string is relatively long or relatively short, and regardless of the sub-geological structure. Drilling operators, concerned about turning the bit off-course during an oscillation procedure, may under-utilize the oscillation features, limiting its effectiveness. Because of this, in some instances, an optimal oscillation may not be achieved, resulting in relatively less efficient drilling and potentially less bit progression.

What is needed is a system that can recommend an effective slide drilling oscillation amount during a drilling process. The present disclosure addresses one or more of the problems of the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
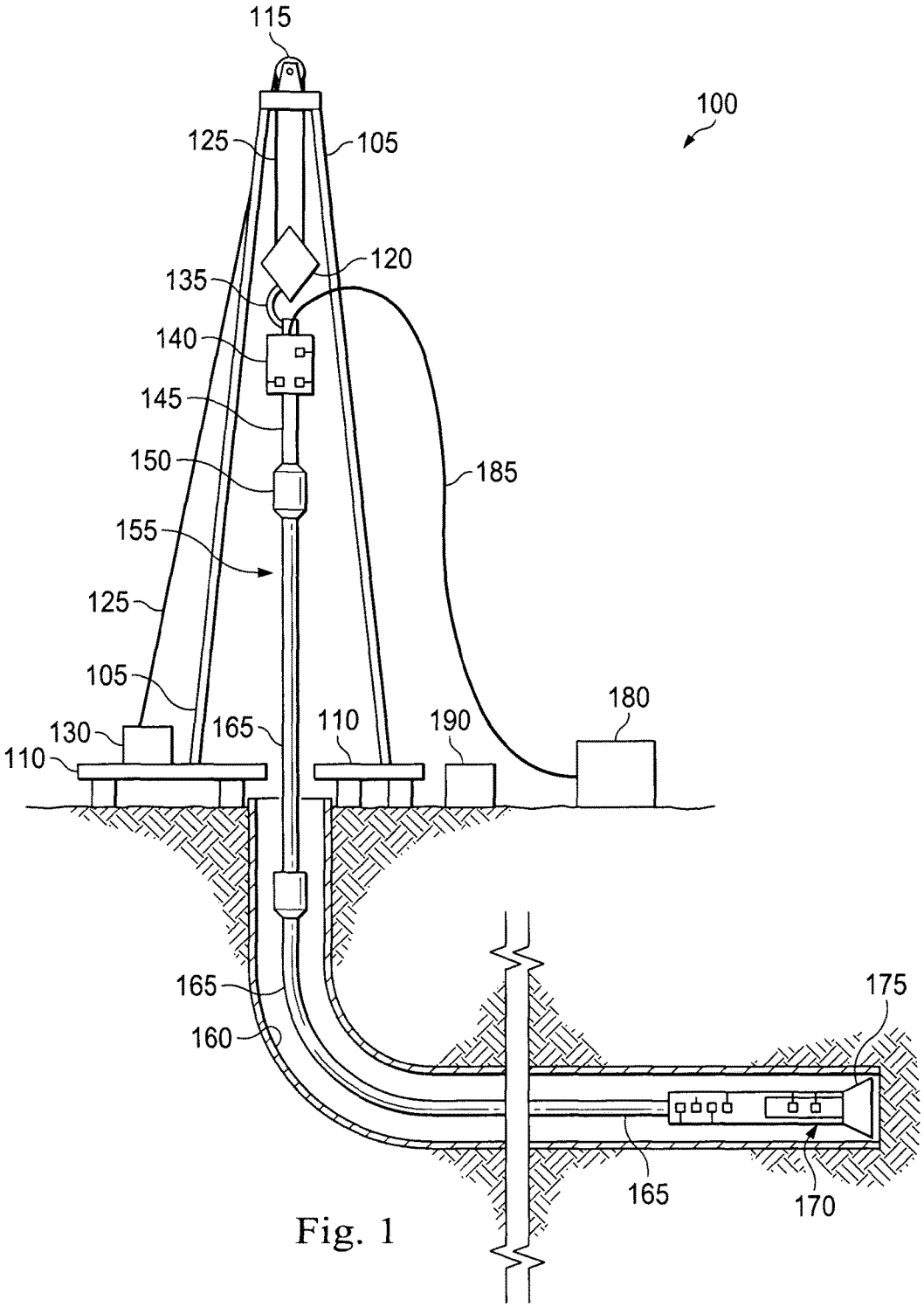
FIG. 1 is a schematic of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

This disclosure provides apparatuses, systems, and methods for improved drilling efficiency by evaluating and determining an oscillation regime target, such as an oscillating revolution target, for a drilling assembly to reduce wellbore friction on a drill string while not disrupting a bit alignment during a slide drilling process. The apparatuses, systems, and methods allow a user (alternatively referred to herein as an "operator") or a control system to determine a suitable number of revolutions (alternatively referred to as rotations or wraps) and modify the number of revolutions to oscillate a tubular string in a manner that improves the drilling operation. The term drill string is generally meant to include any tubular string. This improvement may manifest itself, for example, by increasing the slide drilling speed, slide penetration rate, the usable lifetime of components, and/or other improvements. In one aspect, the system may modify the oscillation regime target, such as the target number of revolutions used in slide drilling based on parameters detected during rotary drilling. These parameters may include, for example, rotary torque, weight on bit, differential pressure, hook load, pump pressure, mechanical specific energy (MSE), rotary RPMs, tool face orientation, and other parameters. In addition, the system may modify the oscillation regime target, such as the number of revolutions based on technical specifications of the drilling equipment or other factors including bit type, pipe diameters, vertical or horizontal depth, and other factors. These may be used to optimize the rate of penetration or another desired drilling parameter by maximizing the number of revolutions, which in turn reduces the wellbore friction along the drill string for a desired length of the drill string, while not changing the orientation of the drill bit during a slide.

In one aspect, this disclosure is directed to apparatuses, systems, and methods that optimize an oscillation regime target, such as the number of revolutions to provide more effective drilling. Drilling may be most effective when the drilling system oscillates the drill string sufficient to rotate the drill string even very deep within the borehole, while permitting the drilling bit to rotate only under the power of the motor. For example, a revolution setting that rotates only the upper half of the drill string will be less effective at reducing drag than a revolution setting that rotates nearly the entire drill string. Therefore, an optimal revolution setting may be one that rotates substantially the entire drill string without upsetting or rotating the bottom hole assembly. Further, since excessive oscillating revolutions during a slide might rotate the bottom hole assembly and undesirably change the drilling direction, the optimal angular setting would not adversely affect the direction of drilling. In another aspect, this disclosure is directed to apparatuses, systems, and methods that optimize an oscillation regime target, such as a target torque level while oscillating in each direction to provide more effective drilling. Therefore, a target torque level may be one that rotates substantially the entire drill string without upsetting or rotating the bottom hole assembly. An oscillation regime target is an optimal or suitably effective target value of an oscillation parameter. These may include, for example, the number of revolutions in each direction during slide drilling or the level of torque reached during oscillations during slide drilling, among others.

The apparatus and methods disclosed herein may be employed with any type of directional drilling system using a rocking technique with an adjustable target number of revolutions or an adjustable target torque, including hand-held oscillating drills, casing running tools, tunnel boring equipment, mining equipment, and oilfield-based equipment such as those including top drives. The apparatus is further discussed below in connection with oilfield-based equipment, but the oscillation revolution selecting device of this disclosure may have applicability to a wide array of fields including those noted above.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

The apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel out and reel in the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. It should be understood that other conventional techniques for arranging a rig do not require a drilling line, and these are included in the scope of this disclosure. In another aspect (not shown), no quill is present.

The drill string 155 includes interconnected sections of drill pipe 165, a bottom hole assembly (BHA) 170, and a drill bit 175. The BHA 170 may include stabilizers, drill collars, and/or measurement-while-drilling (MWD) or wireline conveyed instruments, among other components. The drill bit 175, which may also be referred to herein as a tool, is connected to the bottom of the BHA 170 or is otherwise attached to the drill string 155. One or more pumps 180 may deliver drilling fluid to the drill string 155 through a hose or other conduit 185, which may be fluidically and/or actually connected to the top drive 140.

In the exemplary embodiment depicted in FIG. 1, the top drive 140 is used to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 also includes a control system 190 configured to control or assist in the control of one or more components of the apparatus 100. For example, the control system 190 may be configured to transmit operational control signals to the drawworks 130, the top drive 140, the BHA 170 and/or the pump 180. The control system 190 may be a stand-alone component installed near the mast 105 and/or other components of the apparatus 100. In some embodiments, the control system 190 is physically displaced at a location separate and apart from the drilling rig.

Figure 2:
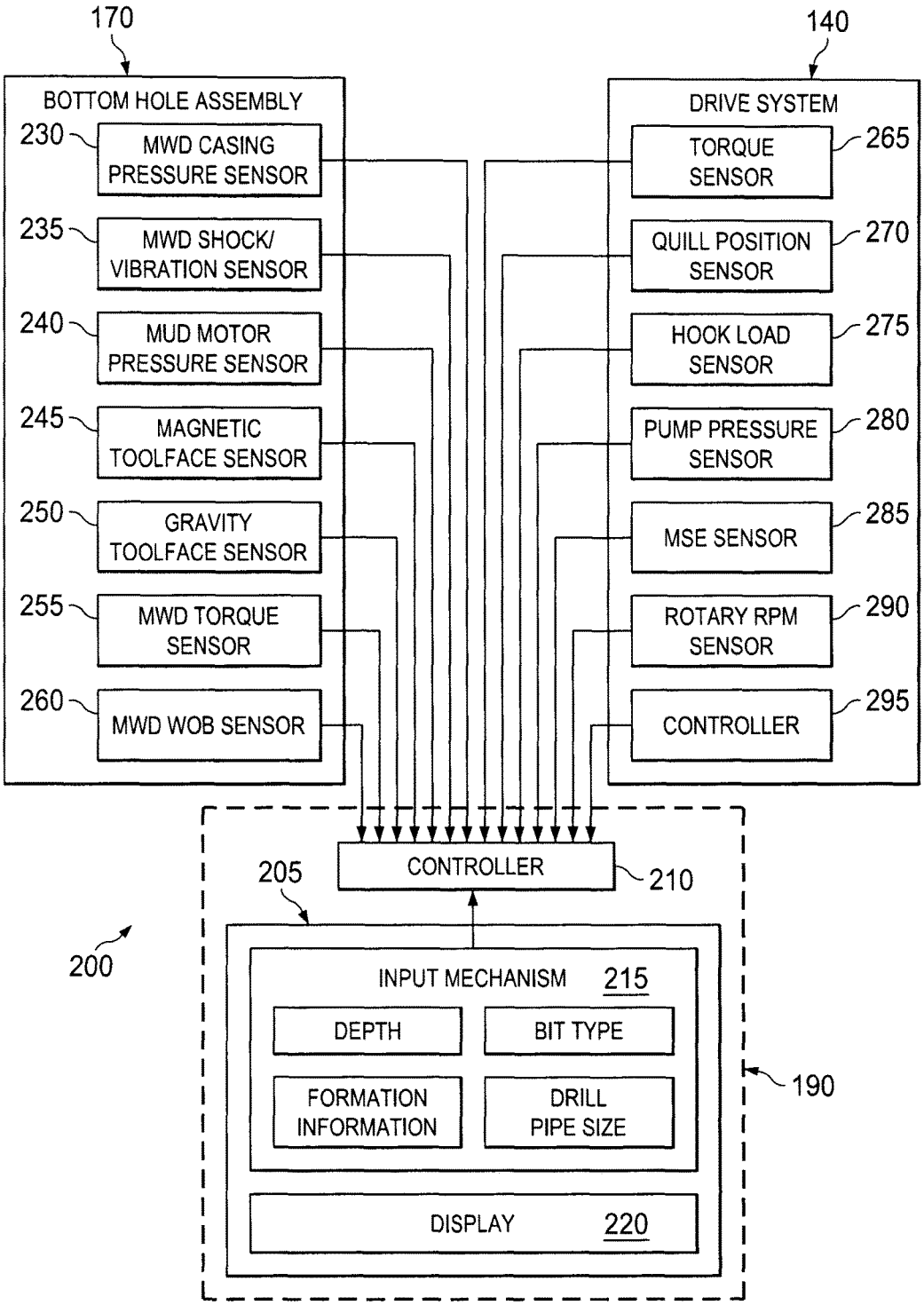
FIG. 2 is a block diagram schematic of an apparatus according to one or more aspects of the present disclosure.

FIG. 2 illustrates a block diagram of a portion of an apparatus 200 according to one or more aspects of the present disclosure. FIG. 2 shows the control system 190, the BHA 170, and the top drive 140, identified as a drive system. The apparatus 200 may be implemented within the environment and/or the apparatus shown in FIG. 1.

The control system 190 includes a user-interface 205 and a controller 210. Depending on the embodiment, these may be discrete components that are interconnected via wired or wireless means. Alternatively, the user-interface 205 and the controller 210 may be integral components of a single system.

The user-interface 205 may include an input mechanism 215 permitting a user to input a left oscillation revolution setting and a right oscillation revolution setting. These settings control the number of revolutions of the drill string as the system controls the top drive or other drive system to oscillate the top portion of the drill string. In some embodiments, the input mechanism 215 may be used to input additional drilling settings or parameters, such as acceleration, toolface set points, rotation settings, and other set points or input data, including a torque target value that may determine the limits of oscillation. A user may input information relating to the drilling parameters of the drill string, such as BHA information or arrangement, drill pipe size, bit type, depth, formation information, among other things. The input mechanism 215 may include a keypad, voice-recognition apparatus, dial, button, switch, slide selector, toggle, joystick, mouse, data base and/or other conventional or future-developed data input device. Such an input mechanism 215 may support data input from local and/or remote locations. Alternatively, or additionally, the input mechanism 215, when included, may permit user-selection of predetermined profiles, algorithms, set point values or ranges, such as via one or more drop-down menus. The data may also or alternatively be selected by the controller 210 via the execution of one or more database look-up procedures. In general, the input mechanism 215 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other means.

The user-interface 205 may also include a display 220 for visually presenting information to the user in textual, graphic, or video form. The display 220 may also be utilized by the user to input drilling parameters, limits, or set point data in conjunction with the input mechanism 215. For example, the input mechanism 215 may be integral to or otherwise communicably coupled with the display 220.

In one example, the controller 210 may include a plurality of pre-stored selectable oscillation profiles that may be used to control the top drive or other drive system. The pre-stored selectable profiles may include a right rotational revolution value and a left rotational revolution value. The profile may include, in one example, 5.0 rotations to the right and −3.3 rotations to the left. These values are preferably measured from a central or neutral rotation.

In addition to having a plurality of oscillation profiles, the controller 210 includes a memory with instructions for performing a process to select the profile. In some embodiments, the profile is a simply one of either a right (i.e., clockwise) revolution setting and a left (i.e., counterclockwise) revolution setting. Accordingly, the controller 210 may include instructions and capability to select a pre-established profile including, for example, a right rotation value and a left rotation value. Because some rotational values may be more effective than others in particular drilling scenarios, the controller 210 may be arranged to identify the rotational values that provide a suitable level, and preferably an optimal level, of drilling speed. The controller 210 may be arranged to receive data or information from the user, the bottom hole assembly 170, and/or the drive system 140 and process the information to select an oscillation profile that might enable effective and efficient drilling.

The BHA 170 may include one or more sensors, typically a plurality of sensors, located and configured about the BHA to detect parameters relating to the drilling environment, the BHA condition and orientation, and other information. In the embodiment shown in FIG. 2, the BHA 170 includes an MWD casing pressure sensor 230 that is configured to detect an annular pressure value or range at or near the MWD portion of the BHA 170. The casing pressure data detected via the MWD casing pressure sensor 230 may be sent via electronic signal to the controller 210 via wired or wireless transmission.

The BHA 170 may also include an MWD shock/vibration sensor 235 that is configured to detect shock and/or vibration in the MWD portion of the BHA 170. The shock/vibration data detected via the MWD shock/vibration sensor 235 may be sent via electronic signal to the controller 210 via wired or wireless transmission.

The BHA 170 may also include a mud motor ΔP sensor 240 that is configured to detect a pressure differential value or range across the mud motor of the BHA 170. The pressure differential data detected via the mud motor ΔP sensor 240 may be sent via electronic signal to the controller 210 via wired or wireless transmission. The mud motor ΔP may be alternatively or additionally calculated, detected, or otherwise determined at the surface, such as by calculating the difference between the surface standpipe pressure just off-bottom and pressure once the bit touches bottom and starts drilling and experiencing torque.

The BHA 170 may also include a magnetic toolface sensor 245 and a gravity toolface sensor 250 that are cooperatively configured to detect the current toolface. The magnetic toolface sensor 245 may be or include a conventional or future-developed magnetic toolface sensor which detects toolface orientation relative to magnetic north or true north. The gravity toolface sensor 250 may be or include a conventional or future-developed gravity toolface sensor which detects toolface orientation relative to the Earth's gravitational field. In an exemplary embodiment, the magnetic toolface sensor 245 may detect the current toolface when the end of the wellbore is less than about 7° from vertical, and the gravity toolface sensor 250 may detect the current toolface when the end of the wellbore is greater than about 7° from vertical. However, other toolface sensors may also be utilized within the scope of the present disclosure that may be more or less precise or have the same degree of precision, including non-magnetic toolface sensors and non-gravitational inclination sensors. In any case, the toolface orientation detected via the one or more toolface sensors (e.g., sensors 245 and/or 250) may be sent via electronic signal to the controller 210 via wired or wireless transmission.

The BHA 170 may also include an MWD torque sensor 255 that is configured to detect a value or range of values for torque applied to the bit by the motor(s) of the BHA 170. The torque data detected via the MWD torque sensor 255 may be sent via electronic signal to the controller 210 via wired or wireless transmission.

The BHA 170 may also include an MWD weight-on-bit (WOB) sensor 260 that is configured to detect a value or range of values for WOB at or near the BHA 170. The WOB data detected via the MWD WOB sensor 260 may be sent via electronic signal to the controller 210 via wired or wireless transmission.

The top drive 140 may also or alternatively may include one or more sensors or detectors that provide information that may be considered by the controller 210 when it selects the oscillation profile. In this embodiment, the top drive 140 includes a rotary torque sensor 265 that is configured to detect a value or range of the reactive torsion of the quill 145 or drill string 155. The top drive 140 also includes a quill position sensor 270 that is configured to detect a value or range of the rotational position of the quill, such as relative to true north or another stationary reference. The rotary torque and quill position data detected via sensors 265 and 270, respectively, may be sent via electronic signal to the controller 210 via wired or wireless transmission.

The top drive 140 may also include a hook load sensor 275, a pump pressure sensor or gauge 280, a mechanical specific energy (MSE) sensor 285, and a rotary RPM sensor 290.

The hook load sensor 275 detects the load on the hook 135 as it suspends the top drive 140 and the drill string 155. The hook load detected via the hook load sensor 275 may be sent via electronic signal to the controller 210 via wired or wireless transmission.

The pump pressure sensor or gauge 280 is configured to detect the pressure of the pump providing mud or otherwise powering the BHA from the surface. The pump pressure detected by the pump sensor pressure or gauge 280 may be sent via electronic signal to the controller 210 via wired or wireless transmission.

The mechanical specific energy (MSE) sensor 285 is configured to detect the MSE representing the amount of energy required per unit volume of drilled rock. In some embodiments, the MSE is not directly sensed, but is calculated based on sensed data at the controller 210 or other controller about the apparatus 100.

The rotary RPM sensor 290 is configured to detect the rotary RPM of the drill string. This may be measured at the top drive or elsewhere, such as at surface portion of the drill string. The RPM detected by the RPM sensor 290 may be sent via electronic signal to the controller 210 via wired or wireless transmission.

In FIG. 2, the top drive 140 also includes a controller 295 and/or other means for controlling the rotational position, speed and direction of the quill 145 or other drill string component coupled to the top drive 140 (such as the quill 145 shown in FIG. 1). Depending on the embodiment, the controller 295 may be integral with or may form a part of the controller 210.

The controller 210 is configured to receive detected information (i.e., measured or calculated) from the user-interface 205, the BHA 170, and/or the top drive 140, and utilize such information to continuously, periodically, or otherwise operate to determine and identify an oscillation regime target, such as a target rotation parameter having improved effectiveness. The controller 210 may be further configured to generate a control signal, such as via intelligent adaptive control, and provide the control signal to the top drive 140 to adjust and/or maintain the oscillation profile in order to most effectively perform a drilling operation.

Moreover, as in the exemplary embodiment depicted in FIG. 2, the controller 295 of the top drive 140 may be configured to generate and transmit a signal to the controller 210. Consequently, the controller 295 of the top drive 170 may be configured to influence the number of rotations in an oscillation, the torque level threshold, or other oscillation regime target. It should be understood the number of rotations used at any point in the present disclosure may be a whole or fractional number.

Figure 3:
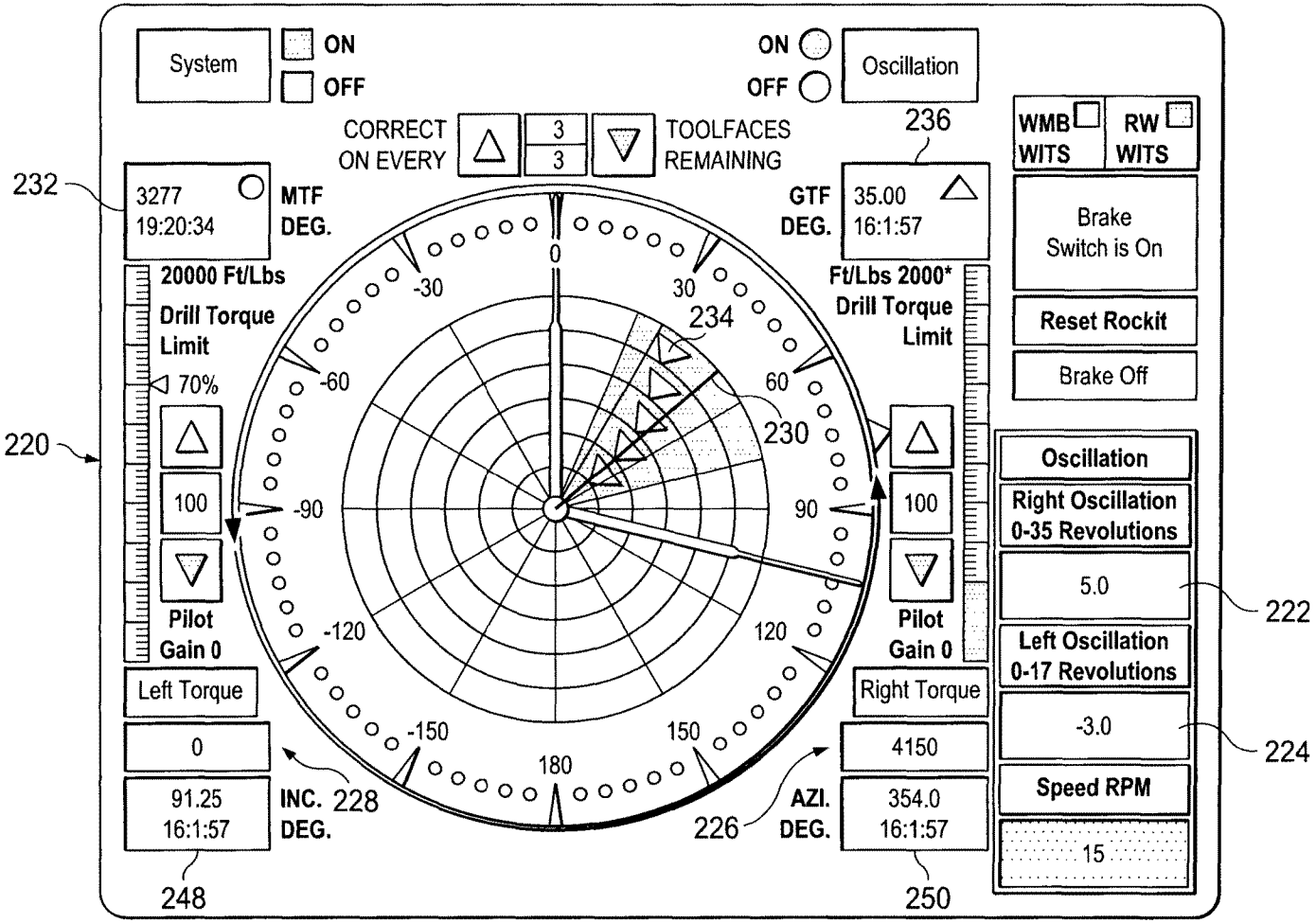
FIG. 3 is a diagram according to one or more aspects of the present disclosure.

FIG. 3 shows a portion of the display 220 that conveys information relating to the drilling process, the drilling rig apparatus 100, the drive system 140, and/or the BHA 170 to a user, such as a rig operator. As can be seen, the display 220 includes a right oscillation amount at 222, shown in this example as 5.0, and a left oscillation amount at 224, shown in this example as −3.0. These values represent the number of revolutions in each direction from a neutral center when oscillating. In a preferred embodiment, the oscillation revolution values are selected to be values that provide a high level of oscillation so that a high percentage of the drill string oscillates, to reduce axial friction on the drill string from the bore wall, while not disrupting the direction of the BHA.

In this example, the display 220 also conveys information relating to the torque settings that may be used as target torque settings to be used during an oscillation regime while slide drilling. Here, right torque and left torque may be entered in the regions identified by numerals 226 and 228 respectively.

In addition to showing the oscillation rotational or revolution values and target torque, the display 220 also includes a dial or target shape having a plurality of concentric nested rings. In this embodiment, the magnetic-based tool face orientation data is represented by the line 230 and the data 232, and the gravity-based tool face orientation data is represented by symbols 234 and the data 236. The symbols and information may also or alternatively be distinguished from one another via color, size, flashing, flashing rate, shape, and/or other graphic means.

In the exemplary display 220 shown in FIG. 3, the display 220 includes a historical representation of the tool face measurements, such that the most recent measurement and a plurality of immediately prior measurements are displayed. However, in other embodiments, the symbols may indicate only the most recent tool face and quill position measurements.

The display 220 may also include a textual and/or other type of indicator 248 displaying the current or most recent inclination of the remote end of the drill string. The display 220 may also include a textual and/or other type of indicator 250 displaying the current or most recent azimuth orientation of the remote end of the drill string. Additional selectable buttons, icons, and information may be presented to the user as indicated in the exemplary display 220. Additional details that may be included or sued include those disclosed in U.S. Pat. No. 8,528,663 to Boone, which is incorporated herein by express reference thereto.

Figure 4:
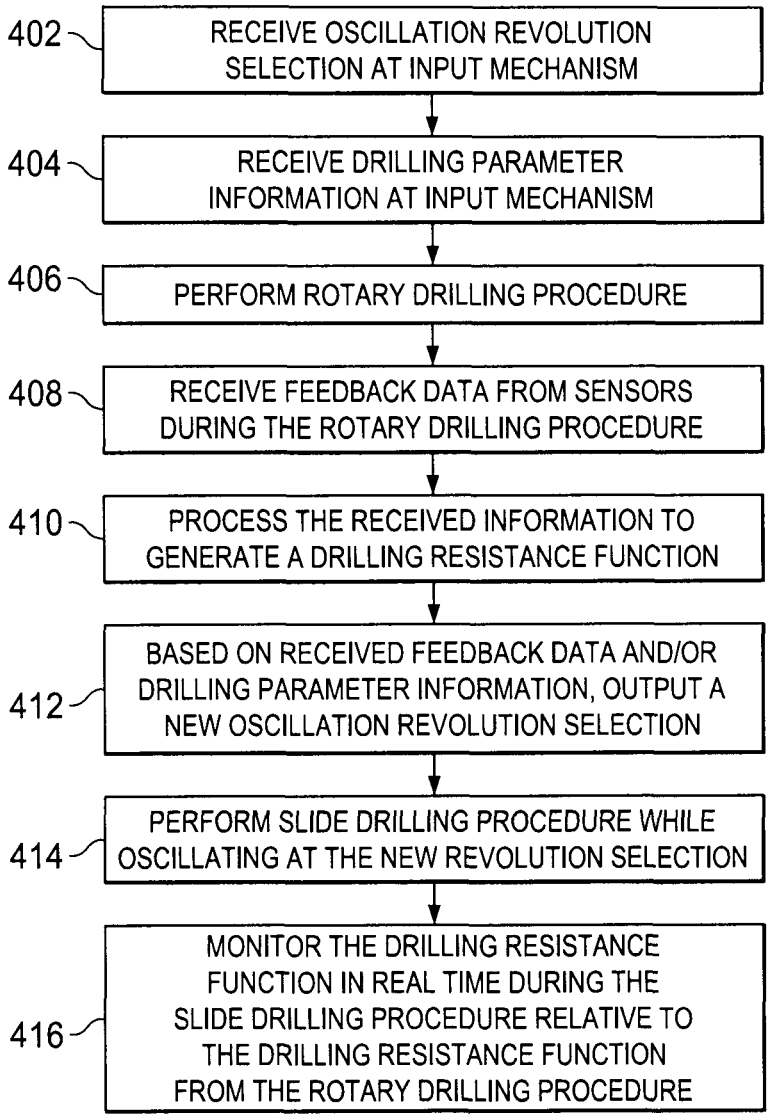
FIG. 4 is a flow-chart diagram of at least a portion of a method according to one or more aspects of the present disclosure.
Figure 5:
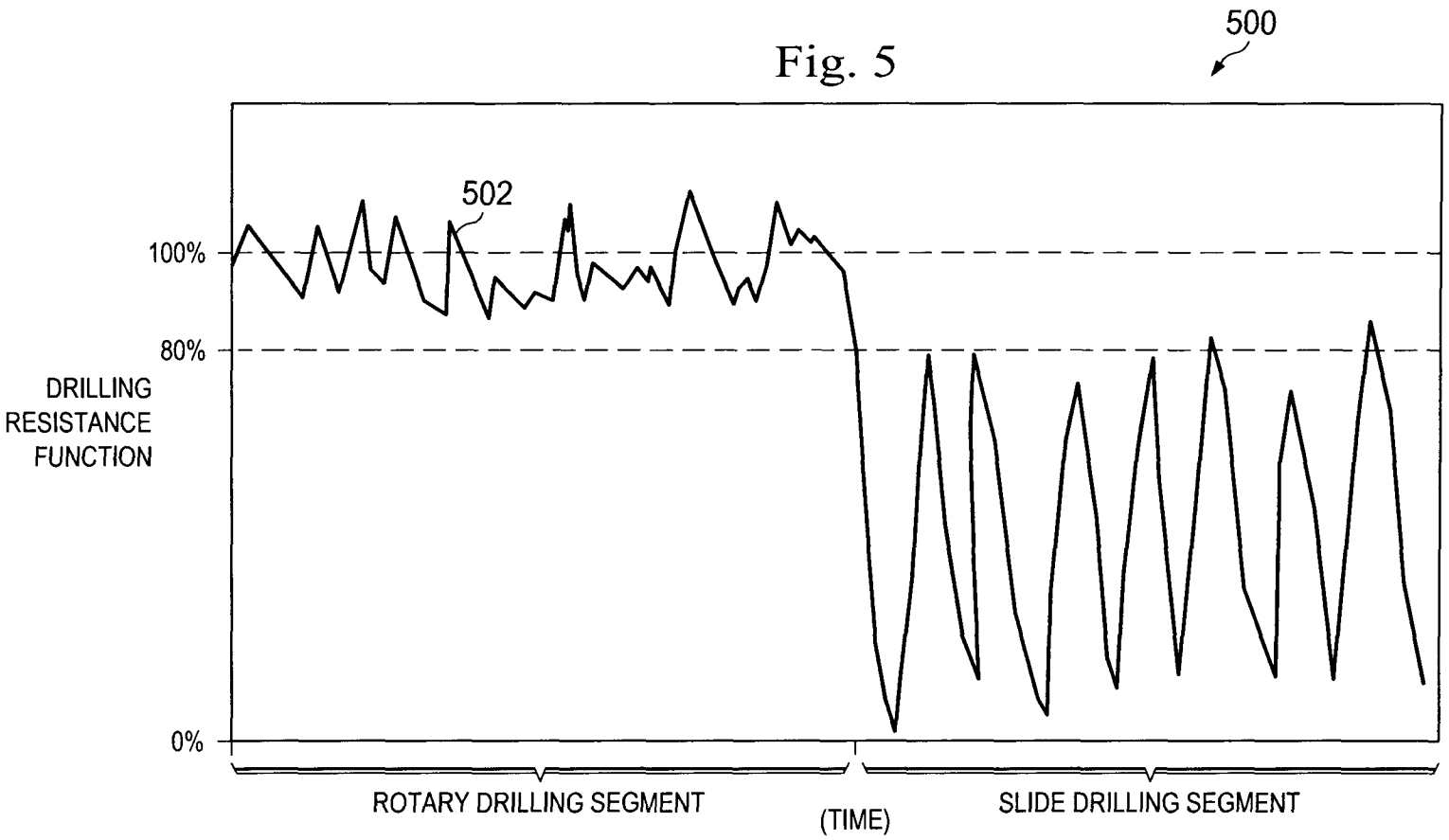
FIG. 5 is a diagram according to one or more aspects of the present disclosure.

FIG. 4 is a flow chart showing an exemplary method 400 of improving slide drilling effectiveness by reducing the amount of friction or drag by optimizing the oscillation revolutions to reduce wellbore friction while maintaining the BHA on course. A portion of the method will be described with reference to FIG. 5 showing exemplary expected results of a drilling function during a rotary drilling procedure and transitioning to a slide drilling procedure. The method begins at 402, where the controller 210 receives an oscillation revolution selection. In some instances, this input may be given at the input mechanism 215. In some instances, this may be carried over from a prior drilling segment, such as from a prior slide drilling segment. In some instances, this may be estimated by the controller 210 based on information relating to input information.

At 404, the controller 210 receives drilling parameter information at the input mechanism 215. This information may include structural parameters of the drilling system, drill pipe, the BHA type or features, or other parameters that might impact the rotational resistance of the drill string. In some embodiments, this is input by a rig operator. In others, it is detected during assembly or setup. The information may include a drill pipe size, such as a diameter of the drill string pipes, information relating to the BHA, such as bit type, size, number of stabilizers, and other information relating the BHA. Additional embodiments allow the rig operator to manually enter, or allow the system to automatically account for bit depth, formation information, and other information. All this information may be received at the controller 210 and stored for consideration.

At 406, the controller 210 controls the drive system 140 to perform a rotary drilling procedure. This includes rotating the drill string to rotate and drive the BHA through the subterranean formations. While performing rotary drilling, and at 408, the controller receives feedback data from sensors. This includes, for example, feedback from the drive system 140, the bottom hole assembly 170, and/or other information relating to the performance of the rig operation during the rotary drilling procedure.

In some aspects, the controller stores a historical record of the feedback generated during the rotary drilling procedure. For example, the controller 210 may receive and store information and data detected over the course of a period of time of the rotary drilling procedure. In some non-limiting examples, the time period may be between about twenty and ninety minutes, although longer and shorter tracking times are contemplated. In some instances, only a short time period immediately prior to slide drilling procedure is recorded. In some instances, rather than taking a sample based on a length of time, the controller 210 may receive and record information based on the amount of time it takes to accomplish a task, such as advance a single tubular stand into the ground. For example, the drive system 140 may take 45 minutes to advance a 90-foot stand, and the controller 210 may store all or a part of the data detected by the sensors during that period of time.

At 410, the controller 210 processes the information detected by the sensors at the drive system 140 and the bottom hole assembly 170 and processes the information received at the input mechanism. This includes generating a drilling resistance function that may be based, for example, on the received information over time. This drilling resistance function may include, for example, weighting different information received or detected to output a value representative of the input and detected information. In some embodiments, this is calculated and stored in real-time during the rotary drilling procedure. The drilling resistance function may be determined based on one or more factors of weight on bit, differential pressure, hook load, pump pressure, rotary torque, MSE, rotary RPM, tool face, depth, bit type, drill pipe size, subterranean formation information and other factors either entered or detected by sensors about the drilling rig apparatus 100. In some examples, rotary torque is weighted more heavily than other factors. In some examples, the drilling resistance function is a function of only rotary torque, weight on bit, and drill pipe size. In yet other examples, the drilling resistance function is a function of rotary torque, weight on bit, drill pipe size, and one or more additional input or detected factors. In yet another example, the drilling resistance function is based only on rotary torque and weight on bit, with rotary torque being weighted more heavily than weight on bit. However, other factors are also contemplated.

FIG. 5 is an exemplary graph 500 showing the representative drilling resistance function 502 during the rotary drilling period. This information is used to determine a recommended oscillation revolution value for both the right and left rotations during a slide drilling procedure that follows. Referring to FIG. 5, the graph 500 includes a drilling resistance function 502 along the y-axis representing the calculated representative value. The x-axis represents time including a rotary drilling segment or period followed immediately thereafter by a slide drilling segment or period.

The exemplary chart of FIG. 5 shows the drilling resistance function over time during the rotary drilling segment. In this example, the drilling resistance function is relatively stable during the rotary drilling segment. As indicated above, the rotary drilling segment may be a period of time immediately prior to a slide and may be any period of time, and may be, for example, an amount of time in the range of about 20 minutes to about 90 minutes. It also may be the time taken to accomplish a task, such as to advance a stand. The controller 210 may process and output the drilling resistance function in real-time during drilling so as to have a real-time output. In other examples, the data from all sensors is saved and averaged, and the controller may then provide a single drilling resistance function for a time period of the rotary drilling segment.

In this chart in FIG. 5, the controller 210 assigns an average value to the drilling resistance function over the designated time period, which in this example, for explanation only, is shown as 100%.

Returning to the flow chart FIG. 4, after processing the received information to generate a drilling resistance function at 410, the controller 210 outputs a new oscillation revolution value based on the received feedback data and/or drilling parameter information at 412. For example, based on the drilling resistance function shown in FIG. 5, the controller 210 is configured to output a recommended number of right oscillation revolutions and a number of left oscillation revolutions. The right and left oscillation revolution numbers may be selected to be revolution values that provide rotation to a relatively high percentage of the drill pipe while not disrupting the direction of the BHA. Because of this, frictional resistance is minimized, while maintaining a low risk or no risk of moving the BHA off course during the slide drilling. To make this selection, the controller 210 may include a table that provides an oscillation revolution value based solely on the drilling resistance function. In some embodiments, the controller 210 may include multiple tables that correspond to the drilling resistance function and additional factors.

In some embodiments, the controller 210 outputs the oscillation revolution values to the user-interface 205, and the values on the display, such as the display 220 in FIG. 3, are automatically updated. In other embodiments, the controller 210 makes recommendations to the operator through the display 220 or other elements of the user-interface 205. When recommendations are made, the operator may choose to accept or decline the recommendations or may make other adjustments, for example, to move the oscillation revolution values closer to the recommended values. In the examples shown, the oscillation revolution values may be, for example, and without limitation, in the range of 0-35 revolutions to the right and 0-17 revolutions to the left. Other ranges and values are contemplated. In some examples, the recommended right and left oscillation values are different.

At 414, the controller 210 may operate the drilling rig apparatus 100 to perform a slide drilling procedure while oscillating at the new recommended oscillation revolution value. Accordingly, by operating at the recommended oscillation revolution values, the slide drilling procedure may be made more efficient by reducing the amount of friction on the drill string while still having low risk of moving the BHA off course.

For explanation only, the slide drilling segment is shown in FIG. 5 immediately following the rotary drilling segment. Here, the recommended oscillation revolution values are such that the drilling resistance function, measured during the slide drilling segment, has a target peak range of about 70% to 80% of the average drilling resistance function taken during the rotary drilling segment time period immediately preceding the slide drilling segment. For example, a target range of about 10.2 oscillation revolutions to the right and 7.9 oscillation revolutions to the left may provide a peak drilling resistance function in a desired range. In FIG. 5, the right and left oscillations appear as spikes in the drilling resistance function during the time period of the slide drilling segment. In other instances, the target peak range is about 80% of the average drilling resistance function taken during the rotary drilling segment and in yet others, the target range is greater than about 50% of the average drilling resistance function taken during the rotary drilling segment.

In some embodiments, at 416 in FIG. 4 the drilling resistance function is monitored during a slide drilling procedure. It may also be taken into account, along with the drilling resistance function, to determine the recommended oscillation revolution values for a subsequent slide drilling procedure. For example, with reference to FIG. 5, the slide drilling segment may be monitored and compared to a threshold determined by the controller. In this example, the threshold is 80% of the average drilling resistance function during the rotary drilling segment. Depending on the embodiment, the 80% threshold may be a ceiling, may be a floor, or may be a target range for the drilling resistance function during the slide drilling segment. By monitoring the drilling resistance function during a slide drilling procedure, the controller 210 may recommend oscillation values taking into account all available information. In some embodiments, the process steps 406 to 414 may be repeated for each rotary drilling procedure followed by a slide drilling procedure. Accordingly, as the BHA proceeds through different subterranean formations, the system may respond by modifying or adapting the approach to address increases or decreases in wellbore resistance for each slide.

While the above method is described to determine a target range of rotational oscillation, the systems and methods described herein also contemplate using the drilling resistance function to determine a target range, threshold, ceiling or floor for any oscillation regime target, including a torque limit used to control the amount of oscillation. Accordingly, the description herein applies equally to other oscillation regimes. For example, it can determine a target torque to be achieved when rotating right and a target torque to be achieved when rotating left. This target may then be input into the controller to provide a more effective operation to increase the effectiveness of slide drilling.

By using the systems and method described herein, a rig operator can more easily operate the rig during slide drilling at a maximum efficiency to minimize the effects of frictional drag on the drill string during slide drilling, while still providing low or minimal risk of rotating the BHA off-course during a slide. This can increase drilling efficiency which saves time and reduces drilling costs.

In view of all of the above and the figures, one of ordinary skill in the art will readily recognize that the present disclosure introduces a method including rotary drilling a first segment of a wellbore by rotating a drill string with a top drive forming a part of a drilling rig apparatus for a first period of time; obtaining data from a sensor disposed about the drilling rig apparatus while rotary drilling for at least a part of the first period of time; based on the data from the sensor, determining a proposed oscillation revolution amount for the drill string to reduce friction of the drill string in the downhole bore without changing the direction of drilling of a bottom hole assembly on the drill string; and slide drilling a second segment of the wellbore while oscillating the drill string using the proposed oscillation revolution amount during a second period of time.

In an aspect, the method includes automatically assigning the proposed oscillation revolution amount to a control system of the top drive so that the slide drilling is performed while oscillating at the proposed oscillation revolution amount. In an aspect, obtaining data from a sensor comprises: obtaining data from multiple sensors measuring multiple different parameters about the drilling rig; and combining the data to create a drilling resistance function representative of the data from the multiple sensors, wherein determining the proposed oscillation revolution is based on the drilling resistance function. In an aspect, the second segment of the wellbore immediately follows the first segment of the wellbore. In an aspect, obtaining data from a sensor includes obtaining data relating to rotary torque from a torque sensor. In an aspect, obtaining data from a sensor includes obtaining data relating to at least one of: weight on bit from a weight on bit sensor, differential pressure from a differential pressure sensor, hook load from a hook load sensor, pump pressure from a pump pressure sensor, mechanical specific energy from an MSE sensor, rotary RPM from a rotary RPM sensor, and a tool face orientation from a tool face sensor. In an aspect, the method includes receiving data from a user and wherein determining a proposed oscillation revolution comprises taking into account the received data from the user. In an aspect, the received data from a user comprises at least one of bit type, drill pipe size, and borehole depth. In an aspect, the method includes presenting the determined proposed oscillation revolution to a user as a recommended setting so that the user can accept the recommendation. In an aspect, the method includes obtaining data from the sensor disposed about the drilling rig apparatus while oscillating the drill string during the slide drilling, and based on the data from the sensor during the slide drilling and based on data obtained during rotary drilling, determining an updated proposed oscillation revolution for the drill string to reduce friction of the drill string in the downhole bore usable during a subsequent slide drilling procedure.

The present disclosure also introduces a drilling apparatus comprising: a top drive controllable to rotate a drill string in a first rotational direction during a rotary drilling operation and to oscillate the drill string in the first rotational direction and an opposite second rotational directional during a slide drilling operation; a sensor configured to detect a measurable parameter of the drilling rig apparatus when the top drive rotates the drill string in the first rotational direction during a rotary drilling operation; and a controller configured to receive information representing the detected measurable parameter from the sensor and based on the received information from the sensor, determine a proposed oscillation revolution amount for the drill string to reduce friction between the drill string and a wall of a borehole while not impacting the direction of slide drilling.

In an aspect, the controller is in communication with the top drive and configured to output control signals to the top drive to oscillate the drill string at the proposed oscillation revolution amount during the slide drilling operation. In an aspect, the controller is configured to determine a proposed oscillation revolution amount for the drill string in the first rotational direction and in the second rotational direction to reduce friction between the drill string and a wall of a borehole while not impacting the direction of slide drilling. In an aspect, the sensor is a torque sensor configured to measure torque during the rotary drilling operation. In an aspect, the sensor comprises at least one of: a weight on bit sensor configured to detect a weight on bit, a differential pressure sensor configured to detect differential pressure, a hook load sensor configured to detect a hook load, a pump pressure sensor configured to detect a pump pressure, a mechanical specific energy sensor configured to detect mechanical specific energy, a rotary RPM sensor configured to detect a rotary RPM, and a tool face sensor configured to detect a tool face orientation. In an aspect, the apparatus includes an interface configured to receive data relating to a configuration of the drill string. In an aspect, the data relating to the configuration of the drill string comprises at least one of bit type, drill pipe size, and borehole depth.

The present disclosure also introduces a drilling method, comprising: rotary drilling a first segment of a wellbore by rotating a drill string with a top drive forming a part of a drilling rig apparatus for a first period of time; obtaining data from a plurality of sensors disposed about the drilling rig apparatus while rotary drilling for at least a part of the first period of time, wherein obtaining data from the plurality of sensors comprises obtaining data relating to rotary torque from a torque sensor and relating to at least one of: weight on bit from a weight on bit sensor, differential pressure from a differential pressure sensor, hook load from a hook load sensor, pump pressure from a pump pressure sensor, mechanical specific energy from a MSE sensor, rotary RPM from a rotary RPM sensor, and a tool face orientation from a tool face sensor; and based on the data from the plurality of sensors, determining a proposed oscillation revolution amount for the drill string in a clockwise direction to reduce friction of the drill string in the downhole bore while not impacting the direction of slide drilling; and based on the data from the plurality of sensors, determining a proposed oscillation revolution amount for the drill string in a counterclockwise direction to reduce friction of the drill string in the downhole bore while not impacting the direction of slide drilling, wherein the counterclockwise amount and the clockwise amount are different.

In an aspect, the method includes slide drilling a second segment of the wellbore while oscillating the drill string with the top drive at the proposed oscillation revolution amount during a second period of time. In an aspect, the method includes receiving data from a user and wherein determining a proposed oscillation revolution amount for both the right and left directions comprises taking into account the received data from the user.

The present disclosure also introduces a drilling method including rotary drilling a first segment of a wellbore by rotating a drill string with a top drive forming a part of a drilling rig apparatus for a first period of time; obtaining data from a sensor disposed about the drilling rig apparatus while rotary drilling for at least a part of the first period of time; based on the data from the sensor, determining a proposed oscillation regime target for the drill string to reduce friction of the drill string in the downhole bore without changing the direction of drilling of a bottom hole assembly on the drill string; and slide drilling a second segment of the wellbore while oscillating the drill string using the proposed oscillation regime target during a second period of time.

In an aspect, the oscillation regime target is an oscillation revolution amount. In an aspect, the oscillation regime target is a target torque limit for a clockwise revolution and a counterclockwise revolution. In an aspect, the method includes automatically setting the oscillation target regime in a control system and automatically oscillating the drill string while slide drilling the second segment in a manner corresponding to the oscillation target regime.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A drilling method, comprising:

rotary drilling a first segment of a wellbore by rotating a drill string with a top drive forming a part of a drilling rig apparatus for a first period of time;

obtaining data from a sensor disposed about the drilling rig apparatus while rotary drilling for at least a part of the first period of time to obtain historical information taken over the at least a part of the first period of time;

based on the obtained historical information from the sensor, determining a proposed oscillation revolution amount for the drill string to reduce friction of the drill string in the wellbore without changing a direction of drilling of a bottom hole assembly on the drill string; and slide drilling a second segment of the wellbore while oscillating the drill string using the proposed oscillation revolution amount during a second period of time.

2. The method of claim 1, comprising automatically assigning the proposed oscillation revolution amount to a control system of the top drive so that the slide drilling is performed while oscillating at the proposed oscillation revolution amount.

3. The method of claim 1, wherein obtaining data from the sensor comprises:

obtaining data from multiple sensors measuring multiple different parameters about the drilling rig; and combining the data to create a drilling resistance function representative of the data from the multiple sensors, wherein determining the proposed oscillation revolution amount is based on the drilling resistance function.

4. The method of claim 1, wherein the second segment of the wellbore immediately follows the first segment of the wellbore.

5. The method of claim 1, wherein obtaining data from the sensor includes obtaining data relating to rotary torque from a torque sensor.

6. The method of claim 1, wherein obtaining data from the sensor includes obtaining data relating to at least one of: weight on bit from a weight on bit sensor, differential pressure from a mud motor differential pressure sensor, hook load from a hook load sensor, pump pressure from a pump pressure sensor, mechanical specific energy from an MSE sensor, rotary RPM from a rotary RPM sensor, or a tool face orientation from a tool face sensor.

7. The method of claim 1, comprising receiving data from a user and wherein determining the proposed oscillation revolution amount comprises taking into account the received data from the user.

8. The method of claim 7, wherein the received data from the user comprises at least one of bit type, drill pipe size, or borehole depth.

9. The method of claim 1, comprising presenting the determined proposed oscillation revolution amount to a user as a recommended setting so that the user can accept the recommendation.

10. The method of claim 1, comprising obtaining data from the sensor disposed about the drilling rig apparatus while oscillating the drill string during the slide drilling, and based on the data from the sensor during the slide drilling and based on the data obtained during rotary drilling, determining an updated proposed oscillation revolution amount for the drill string to reduce friction of the drill string in the wellbore usable during a subsequent slide drilling procedure.

11. A drilling rig apparatus comprising:

a top drive controllable to rotate a drill string in a first rotational direction during a rotary drilling operation and to oscillate the drill string in the first rotational direction and an opposite second rotational direction during a slide drilling operation;

a sensor configured to detect a measurable parameter of the drilling rig apparatus when the top drive rotates the drill string in the first rotational direction during the rotary drilling operation; and a controller configured to receive information representing the detected measurable parameter from the sensor over a period of time during the rotary drilling operation to obtain historical data taken over the period of time and based on the obtained historical data, determine a proposed oscillation revolution amount for the drill string to reduce friction between the drill string and a wall of a borehole while not impacting a direction of slide drilling.

12. The apparatus of claim 11, wherein the controller is in communication with the top drive and configured to output control signals to the top drive to oscillate the drill string at the proposed oscillation revolution amount during the slide drilling operation.

13. The apparatus of claim 11, wherein the controller is configured to determine a proposed oscillation revolution amount for the drill string in the first rotational direction and in the second rotational direction to reduce friction between the drill string and the wall of a borehole while not impacting the direction of slide drilling.

14. The apparatus of claim 11, wherein the sensor is a torque sensor configured to measure torque during the rotary drilling operation.

15. The apparatus of claim 11, wherein the sensor comprises at least one of: a weight on bit sensor configured to detect a weight on bit, a mud motor differential pressure sensor configured to detect differential pressure, a hook load sensor configured to detect a hook load, a pump pressure sensor configured to detect a pump pressure, a mechanical specific energy sensor configured to detect mechanical specific energy, a rotary RPM sensor configured to detect a rotary RPM, or a tool face sensor configured to detect a tool face orientation.

16. The apparatus of claim 11, further comprising an interface configured to receive data relating to a configuration of the drill string.

17. The apparatus of claim 16, wherein the data relating to the configuration of the drill string comprises at least one of bit type, drill pipe size, or borehole depth.

18. A drilling method, comprising:

rotary drilling a first segment of a wellbore by rotating a drill string with a top drive forming a part of a drilling rig apparatus for a first period of time;

obtaining data from a plurality of sensors disposed about the drilling rig apparatus while rotary drilling for at least a part of the first period of time to obtain historical information taken over the at least a part of the first period of time, wherein obtaining data from the plurality of sensors comprises obtaining data relating to rotary torque from a torque sensor and relating to at least one of: weight on bit from a weight on bit sensor, differential pressure from a mud motor differential pressure sensor, hook load from a hook load sensor, pump pressure from a pump pressure sensor, mechanical specific energy from a MSE sensor, rotary RPM from a rotary RPM sensor, or a tool face orientation from a tool face sensor; and based on the obtained historical information from the plurality of sensors, determining a proposed oscillation revolution amount for the drill string in a clockwise direction to reduce friction of the drill string in the wellbore while not impacting a direction of slide drilling;

based on the obtained historical information from the plurality of sensors, determining a proposed oscillation revolution amount for the drill string in a counterclockwise direction to reduce friction of the drill string in the wellbore while not impacting the direction of slide drilling, wherein the proposed oscillation revolution amount in the counterclockwise direction and the proposed oscillation revolution amount in the clockwise direction are different; and slide drilling while oscillating the drill string at the determined proposed oscillation revolution amount.

19. The method of claim 18, comprising slide drilling a second segment of the wellbore while oscillating the drill string with the top drive at the proposed oscillation revolution amount during a second period of time.

20. The method of claim 18, comprising receiving data from a user and wherein determining the proposed oscillation revolution amount for both right and left directions comprises taking into account the received data from the user.

21. A drilling method, comprising:

rotary drilling a first segment of a wellbore by rotating a drill string with a top drive forming a part of a drilling rig apparatus for a first period of time;

obtaining data from a sensor disposed about the drilling rig apparatus while rotary drilling for at least a part of the first period of time to obtain historical information taken over the at least a part of the first period of time;

based on the obtained historical information from the sensor, determining a proposed oscillation regime target for the drill string to reduce friction of the drill string in the wellbore without changing a direction of drilling of a bottom hole assembly on the drill string; and slide drilling a second segment of the wellbore while oscillating the drill string using the proposed oscillation regime target during a second period of time.

22. The method of claim 21, wherein the oscillation regime target is an oscillation revolution amount.

23. The method of claim 21, wherein the oscillation regime target is a target torque limit for a clockwise revolution and a counterclockwise revolution.

24. The method of claim 21, further comprising automatically setting the oscillation regime target in a control system and automatically oscillating the drill string while slide drilling the second segment in a manner corresponding to the oscillation regime target.

* * * * *